US006951069B1

(12) United States Patent
Talbot-Kelly

(10) Patent No.: US 6,951,069 B1
(45) Date of Patent: Oct. 4, 2005

(54) METHOD AND APPARATUS FOR FRAMING OF OBJECTS

(76) Inventor: Mark A. Talbot-Kelly, 209 Grove Pl. Apt. 105, San Antonio, TX (US) 78209

( * ) Notice: Subject to any disclaimer, the term of this patent is extended or adjusted under 35 U.S.C. 154(b) by 0 days.

(21) Appl. No.: 09/706,436

(22) Filed: Nov. 3, 2000

(51) Int. Cl.[7] ..... A47G 1/16; A47G 1/00
(52) U.S. Cl. ..... 40/790; 40/764; 40/780
(58) Field of Search ..... 40/745, 761, 661.12, 40/606.17, 606.18, 729, 730, 764, 798, 799, 783, 780, 605, 152, 152.1; 446/111, 112, 115, 116, 124; D6/300, 310; 248/174, 188, 459

(56) References Cited

U.S. PATENT DOCUMENTS

| | | | | | |
|---|---|---|---|---|---|
| 975,094 | A | * | 11/1910 | Williams | 40/700 |
| 1,603,796 | A | * | 10/1926 | Pell | 40/761 |
| D181,474 | S | * | 11/1957 | Jimenez | D6/300 |
| 2,940,606 | A | * | 6/1960 | Kurnitz | 211/183 |
| 3,105,316 | A | * | 10/1963 | Ison | 40/780 |
| 3,855,748 | A | * | 12/1974 | Thomas | 52/578 |
| 4,385,459 | A | * | 5/1983 | McGrath et al. | 40/730 |
| 6,385,886 | B1 | * | 5/2002 | Chepikian | 40/729 |

FOREIGN PATENT DOCUMENTS

| | | | | |
|---|---|---|---|---|
| CA | 638149 | * | 3/1962 | 40/152 |

* cited by examiner

*Primary Examiner*—Cassandra H. Davis
(74) *Attorney, Agent, or Firm*—Wayne J. Colton, Inc.

(57) ABSTRACT

A framing system for dependently supporting an object generally comprises a plurality of frame elements for perimetrically engaging the object to be framed and a plurality of securing members. The frame elements are defined one from another by a plurality of interiorly projecting slots in their outer perimeter. For engaging the frame elements to secure the object to be framed, the securing members each comprise an extended slot. Upon mating of the extended slot of a securing member with a one of the interiorly projecting slots, a distal portion of the securing member projects into the inner perimeter of the frame elements to engage the outer edge of the object to be framed. The frame elements may comprise a single structure or a plurality of structures. In the case of a plurality of structures, the framing system may be formed to have a unitary base and a unitary top. Framing of an object is thus simplified as the object need only be placed into the unitary base, whereafter the unitary top may be affixed. The frame elements may comprise geometrical extrusions of any of a variety of shapes. The securing members may comprise any of a variety of shapes. Some of the frame elements may comprise a translucent material and be interiorly provided with a light fixture for illuminating the framed object.

13 Claims, 10 Drawing Sheets

METHOD AND APPARATUS FOR FRAMING OF OBJECTS

FIELD OF THE INVENTION

The present invention relates to framing systems. More particularly, the invention relates to a method and apparatus whereby objects of a wide variety of shapes and topographies may be dependently framed by a border of any of a wide variety of perimetrical shapes and geometric cross-sections.

BACKGROUND OF THE INVENTION

From nearly as long as mankind has engaged in the creative arts various framing systems have been developed for the display of these works. Unfortunately, notwithstanding the great length of time over which such framing systems have been developed, the known systems remain cumbersome in use and generally limited to very particular applications. It is therefore an overriding object of the present invention to improve over the prior art by providing a framing system that is not only easy to use but also well-adapted for use in the display of a wide variety of objects.

SUMMARY OF THE INVENTION

In accordance with the foregoing object, the present invention—a framing system for dependently supporting an object—generally comprises a plurality of frame elements for perimetrically engaging the object to be framed and a plurality of securing members. The frame elements are defined one from another by a plurality of interiorly projecting slots in their outer perimeter. For engaging the frame elements to secure the object to be framed, the securing members each comprise an extended slot. Upon mating of the extended slot of a securing member with a one of the interiorly projecting slots, a distal portion of the securing member projects into the inner perimeter of the frame elements to engage the outer edge of the object to be framed.

The frame elements may comprise a single structure or a plurality of structures. In the case of a plurality of structures, the framing system may be formed to have a unitary base and a unitary top. In this manner, framing of an object is simplified as the object need only be placed into the unitary base, whereafter the unitary top may be affixed.

The frame elements may comprise geometrical extrusions of any of a variety of shapes. Likewise, the securing members may comprise any of a variety of shapes. In at least one embodiment, some of the frame elements preferably comprise a translucent material and are interiorly provided with a light fixture for illuminating the framed object.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Figure 1:
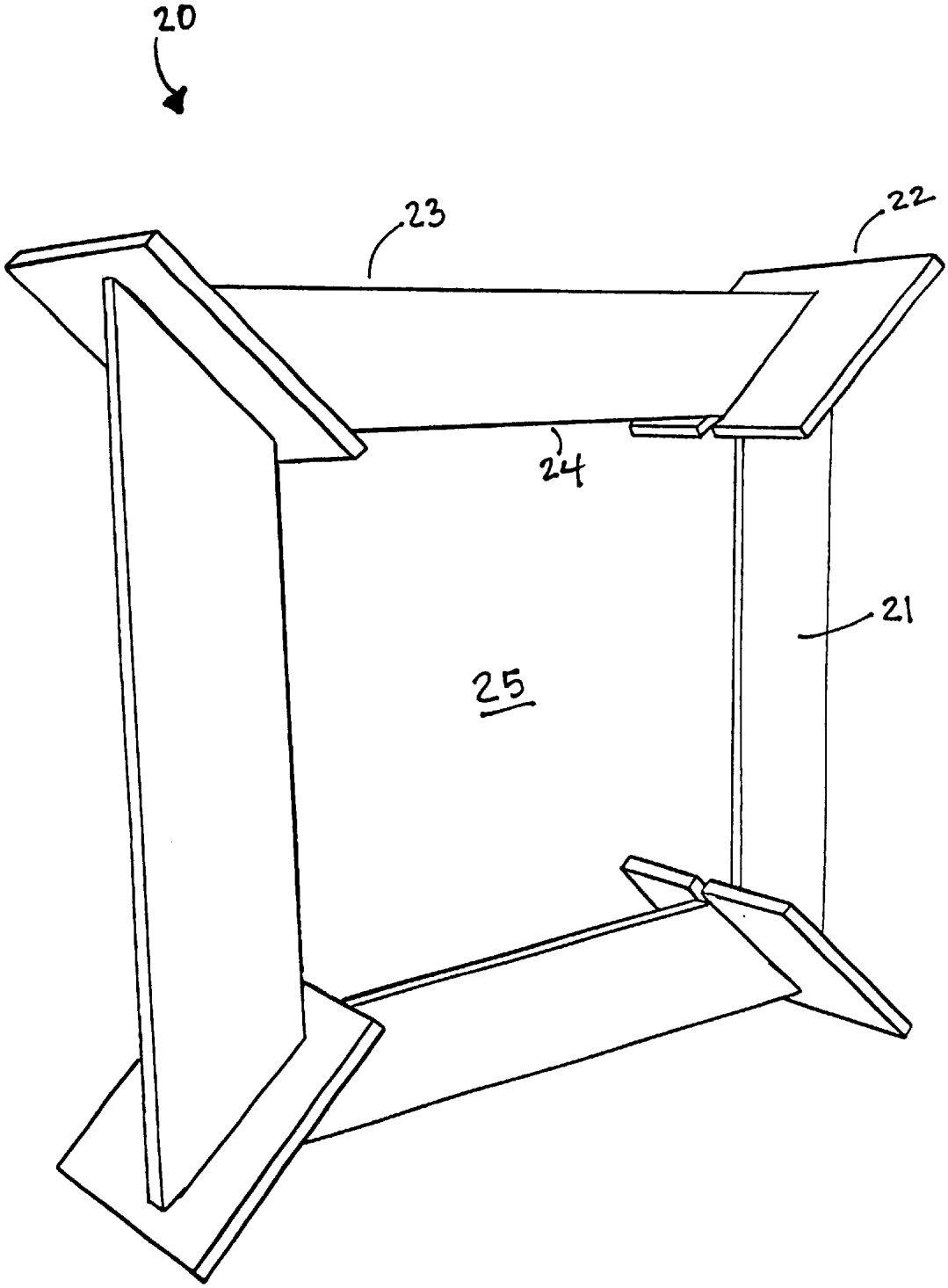
FIG. 1 shows, in a perspective view, a first preferred embodiment of the framing system of the present invention.
Figure 2:
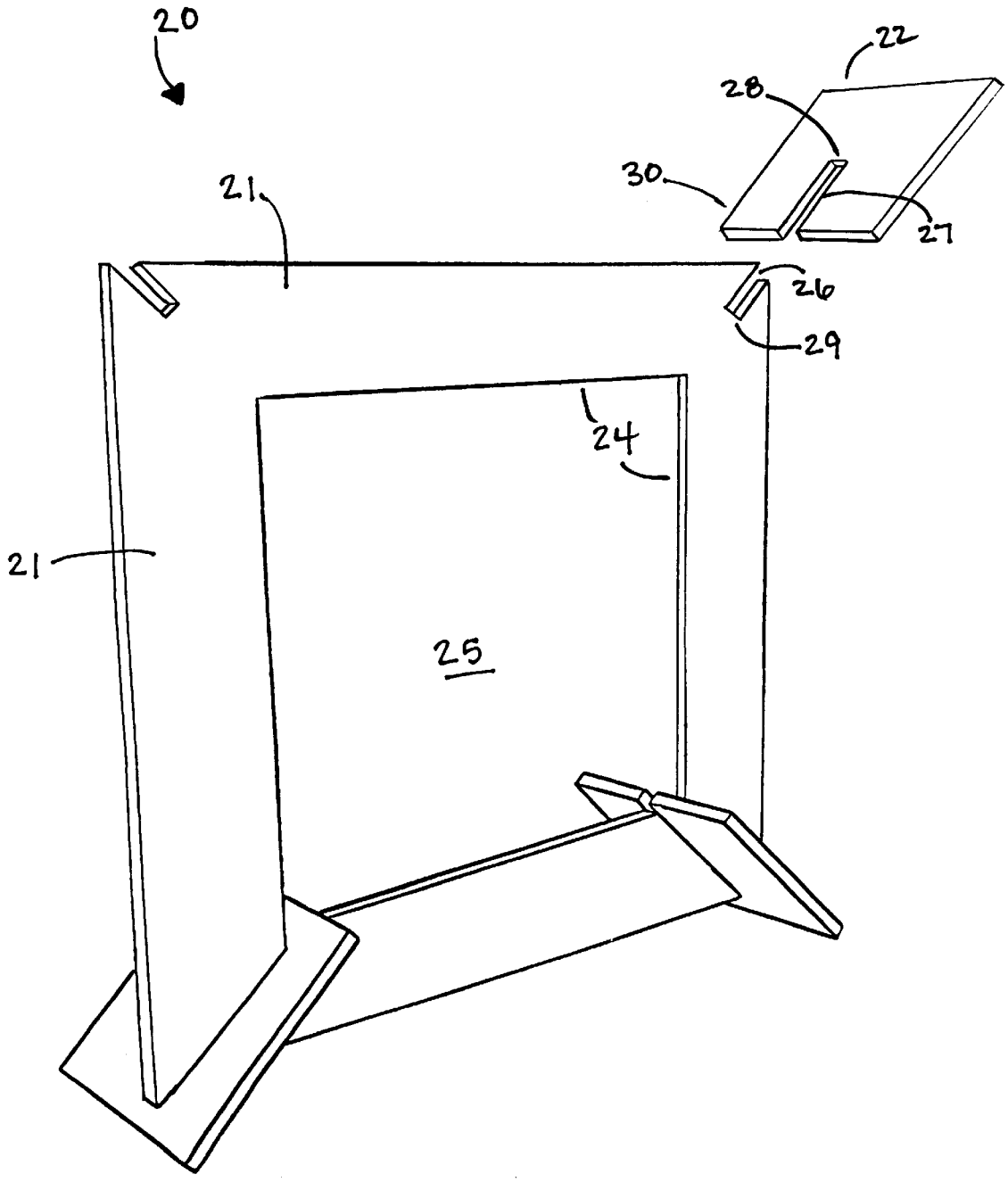
FIG. 2 shows, in a partially exploded view, the framing system of FIG. 1.

Referring now to FIG. 1, the framing system 20 of the present invention is shown to generally comprise a plurality of frame elements 21, which form an outer frame perimeter 23 and an inner frame perimeter 24 about an interior frame space 25, and a plurality of securing members 22. As shown in FIG. 2, each frame element 21 is defined one from another by a plurality of interiorly projecting slots 26.

As also shown in the figure, an extended slot 27, formed in each securing member 22, is provided for engaging the securing members 22 with the frame elements 21. As will be better understood further herein, each extended slot 27 is formed of a length such that when the back edge 28 of the extended slot 27 mates with the interior edge 29 of the interiorly projecting slot 26 at least a distal portion 30 of the securing member 22 projects into the interior frame space 25 defined by the inner frame perimeter 24. In this manner, the extended slot 27 in the area of the distal portion 30 of the securing member 22 is adapted to engage about and secure an edge portion 31 of a framed object 32.

Figure 3:
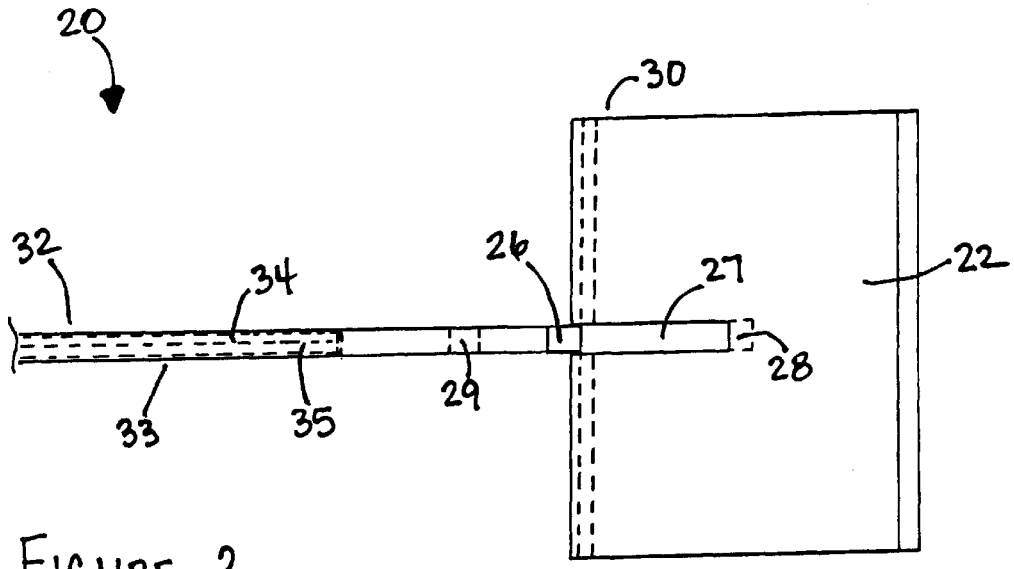
FIG. 3 shows, in a partially cut away top plan view, the framing system as depicted in FIG. 2, but also including a framed object.
Figure 4:
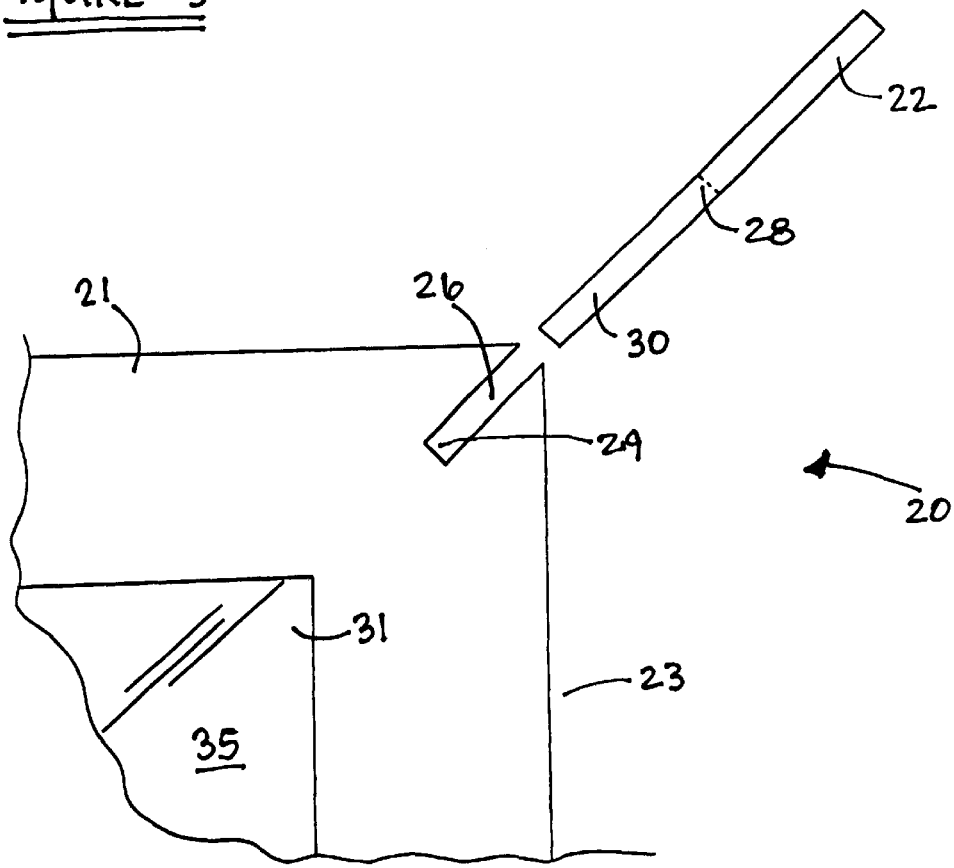
FIG. 4 shows, in a partially cut away front elevational view, the framing system as depicted in FIG. 3.
Figure 5:
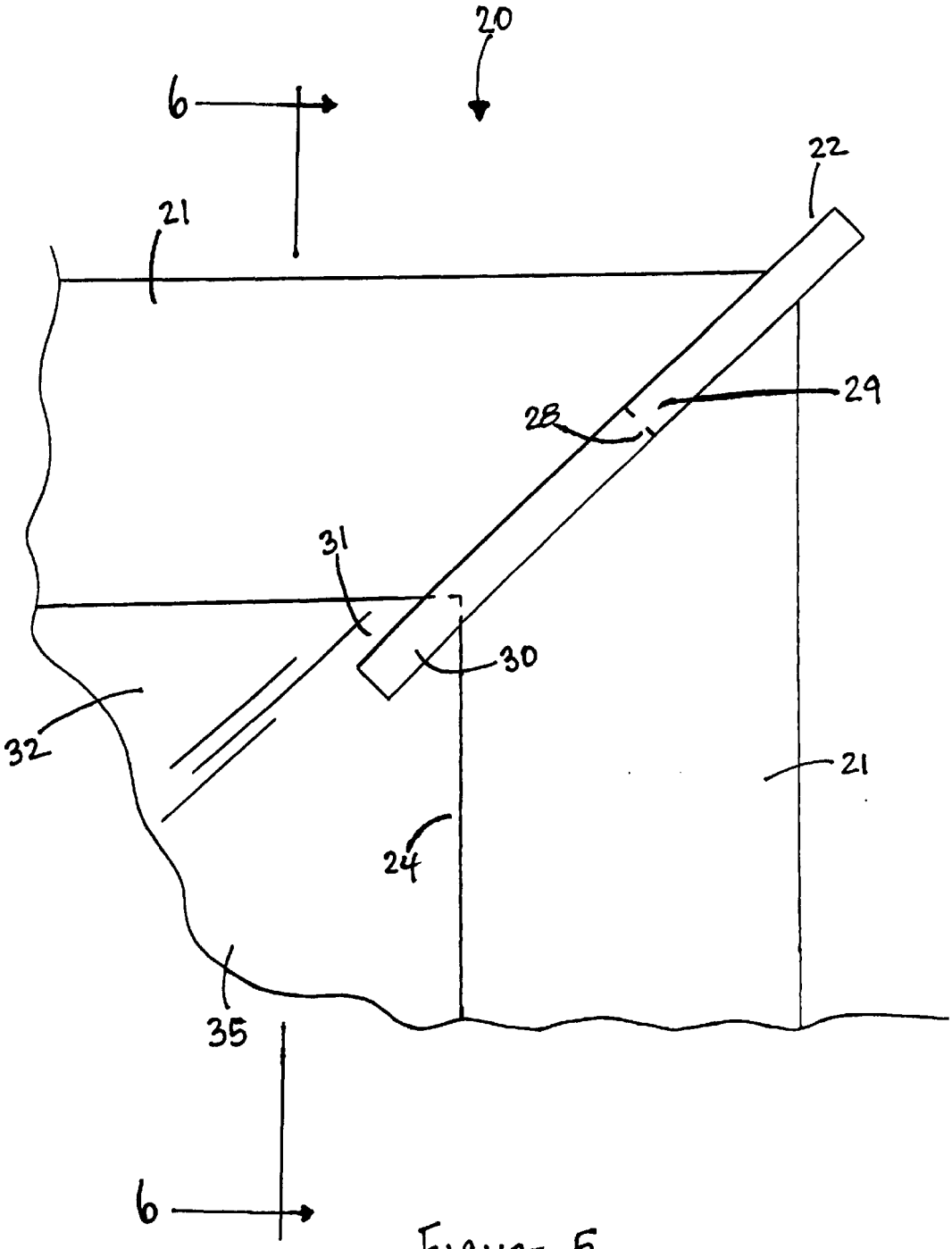
FIG. 5 shows, in a partially cut away front elevation view, the framing system as depicted in FIG. 1, but also including a framed object.
Figure 6:
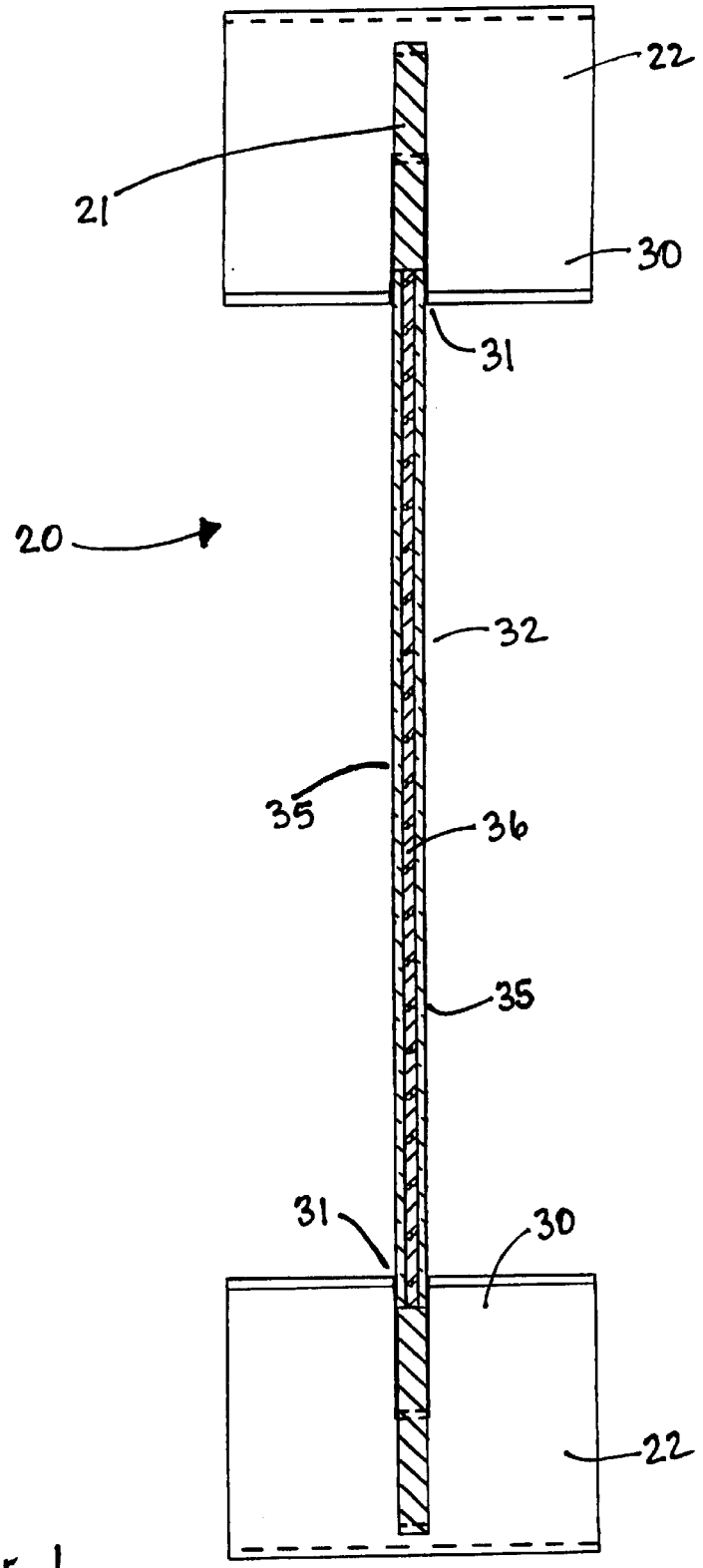
FIG. 6 shows, in a cross-sectional view taken along line 6—6 in FIG. 5, the first preferred embodiment of the framing system of the present invention.

As shown in FIGS. 3 and 4, such a framed object may comprise a laminated object 33 such as, for example, a poster board 34 mated against a glass pane 35 or, by way of further example, as shown in FIG. 6, a thin paper sheet 36 secured between two glass panes 35. Those of ordinary skill in the art will recognize, however, especially in light of this exemplary specification, that the framing system of the present invention is well-suited for use in the display of virtually any object.

Figure 7:
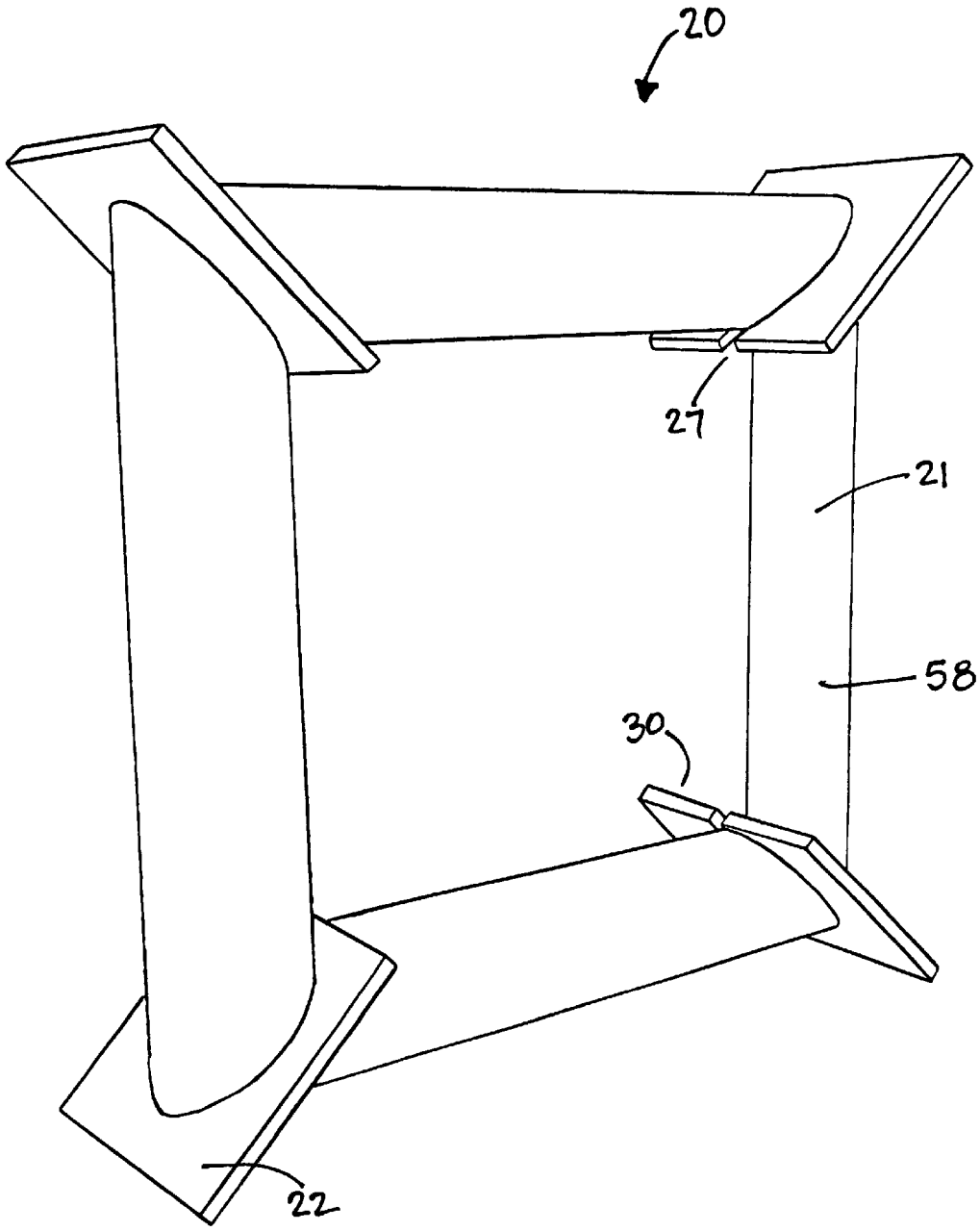
FIG. 7 shows, in a perspective view, a second preferred embodiment of the present invention.
Figure 8:
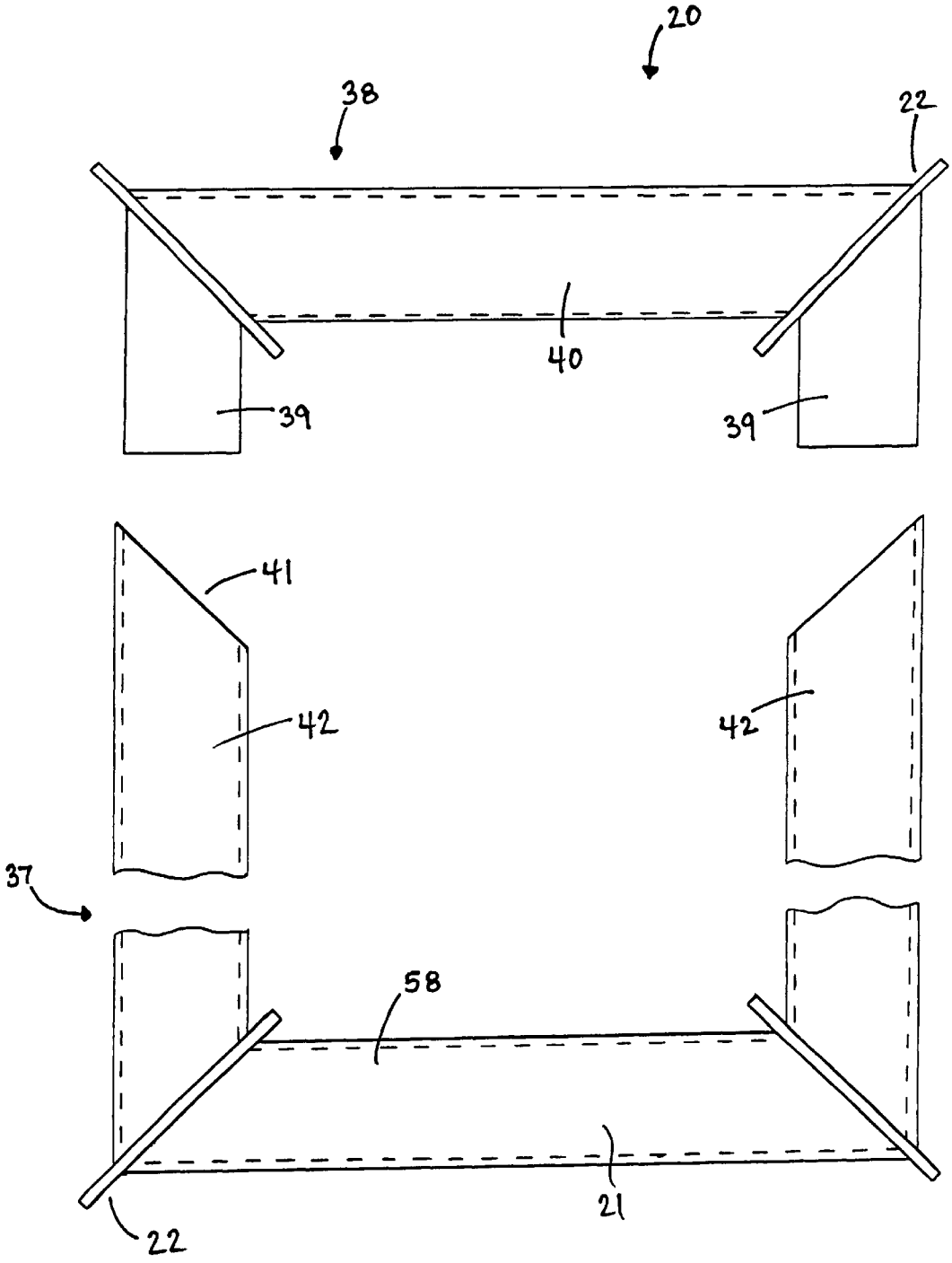
FIG. 8 shows, in a front elevational view, details of the second preferred embodiment of the present invention.

Although the securing members 22 are shown in the various figures to generally comprise a rectilinear shape, those of ordinary skill in the art will recognize that the securing members 22 may comprise virtually any uniform or non-uniform geometry, including but not limited to block, spheroid, or the like. Likewise, as particularly shown in FIGS. 7 and 8, the frame elements 21 need not comprise the rectilinear geometry depicted in FIGS. 1 through 6 to which many prior art framing systems are limited. As shown in FIGS. 7 and 8, the frame elements 21 of the present invention may comprise, for example, cylindrical extrusions 58 or virtually any other cross-sectional shape desired for a particular application. Additionally, those of ordinary skill in the art will recognize that, unlike in conventional framing systems, both the frame elements 21 and the securing members 22 may comprise virtually any material of construction.

As shown in FIG. 8, the framing system 20 of the present invention may also comprise a unitary base 37 with a corresponding unitary top 38. In this embodiment, a plurality of tongues 39 may be formed integral with the upper frame elements 40 for insertion into a corresponding number of receiving slots 41 in the side frame elements 42. In this manner, objects may be readily framed in the more complex embodiment by simply inserting such an object into the unitary base 37 and thereafter capturing the upper edge portion 31 of the framed object 32 in the extended slots 27 of the unitary top 38 by insertion of the tongues 39 into the receiving slots 41.

Figure 9:
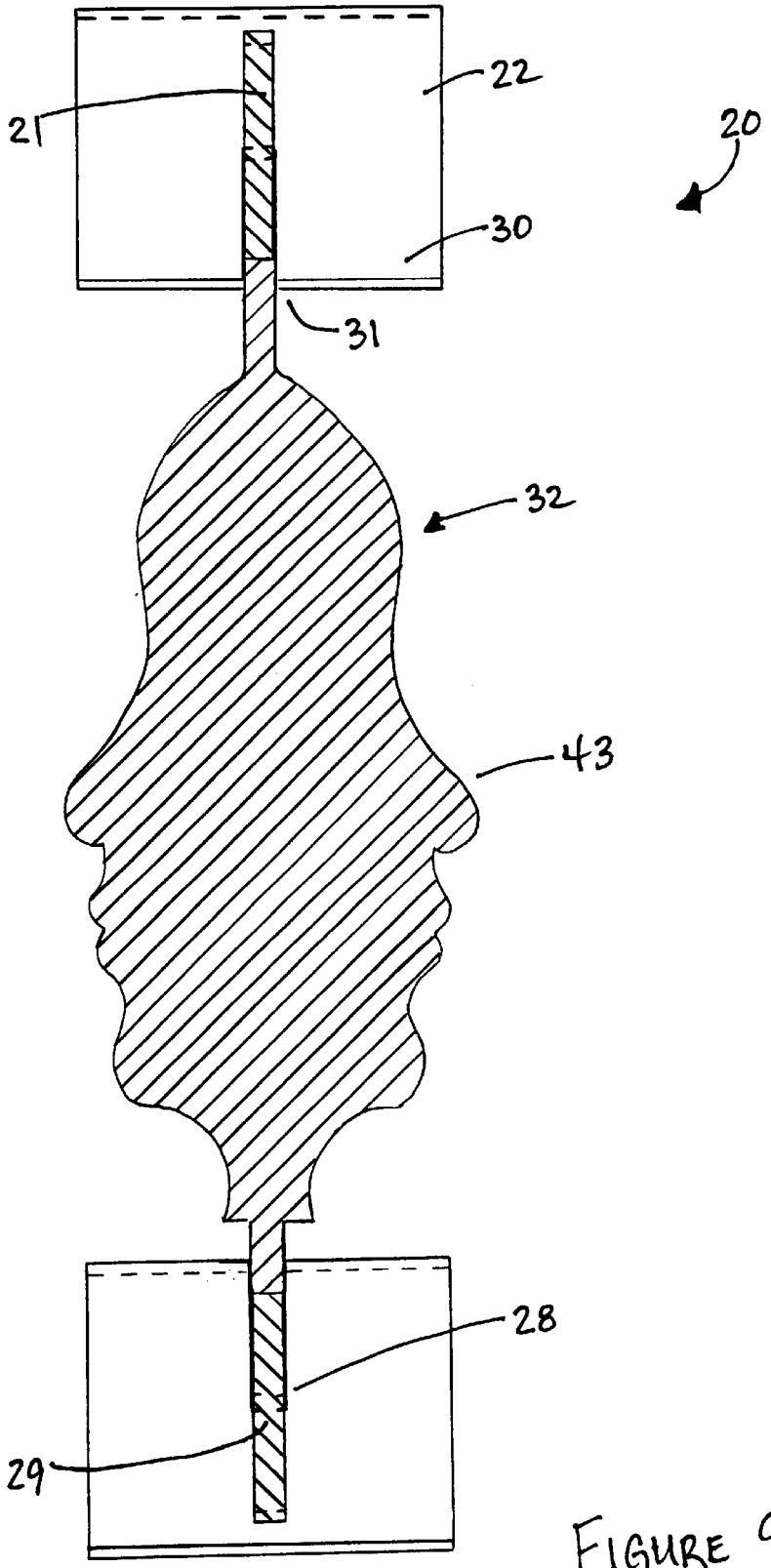
FIG. 9 shows, in a cross-sectional view similar to that of FIG. 6, one of the variety of uses for which the present invention is suited.

As shown in FIG. 9, the framing system 20 of the present invention is also particularly adapted for the framing of an object 32 exhibiting a non-uniform surface. For example, the topographical casting 43 depicted in FIG. 9 is easily framed by employing the principals of the present invention. The only requirement of the object 32 to be framed is that the edge portion 31 the framed object 32 fit securely within the extended slot 27 at the distal portion 30 of the securing member 22.

Figure 10:
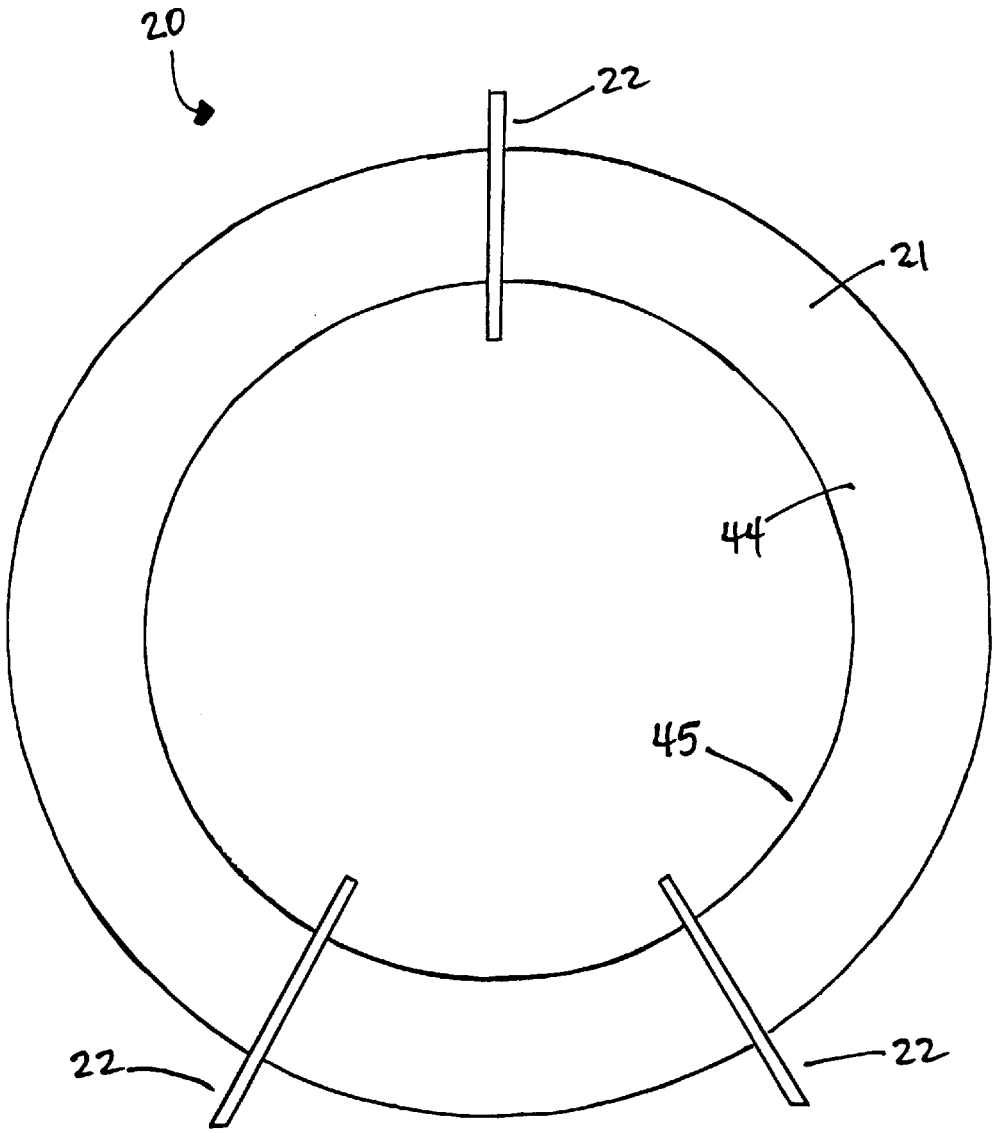
FIG. 10 shows, in a front elevational view, a third preferred embodiment of the framing system of the present invention.

As particularly shown in FIG. 10, it is to be understood that the framing system 20 of the present invention is not limited to any particular number of frame elements 21 nor to any particular shape for the frame elements 21. For example, a toroidal extrusion 44 may form each frame element 21 in order to provide a circular inner perimeter 45. Likewise, it is only critical that a sufficient number of securing members 22, which may engage the frame elements 21 in any desired plane, be provided to dependently support the edge portions 31 of the framed object 32.

Figure 11:
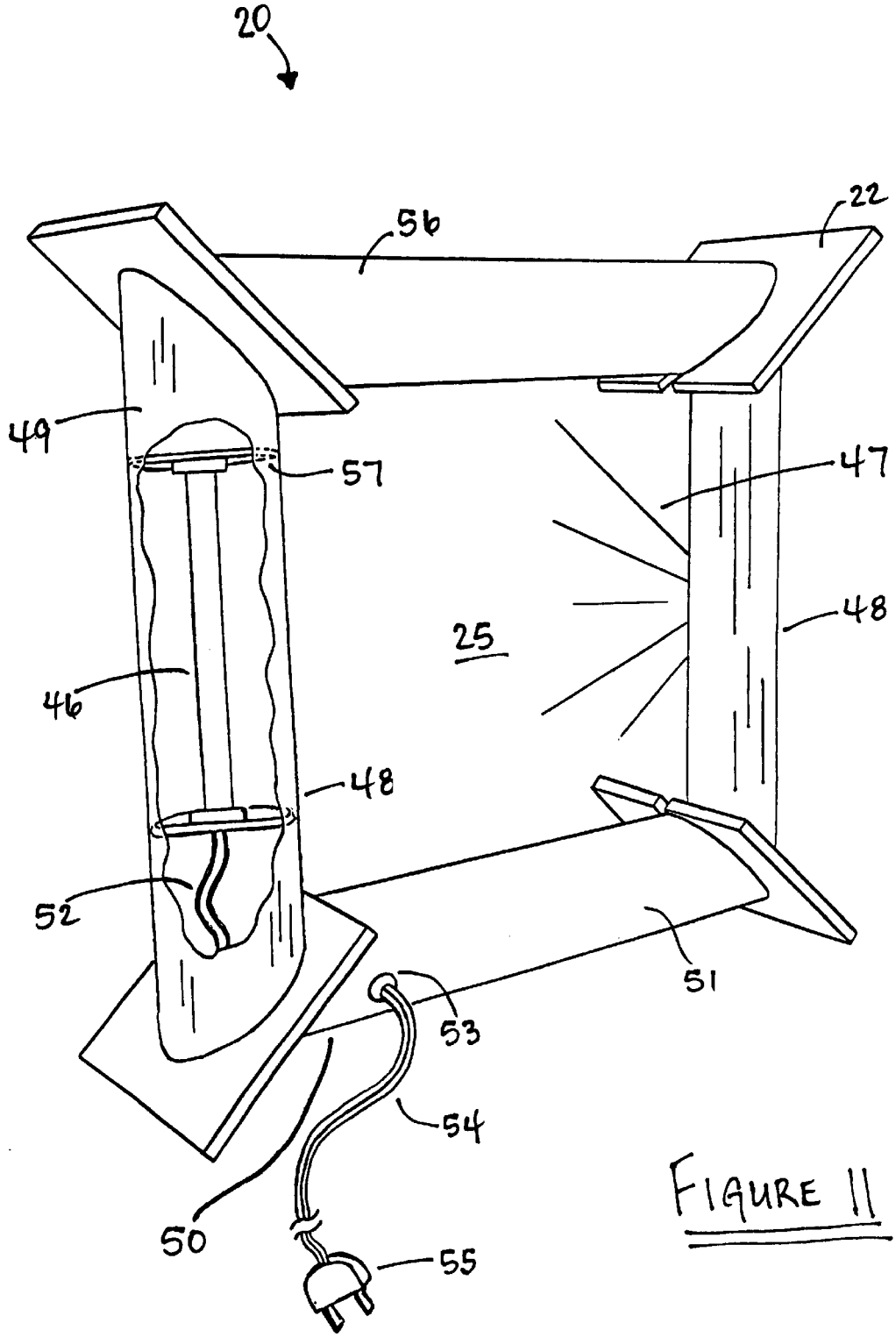
FIG. 11 shows, in a partially cut away perspective view, a fourth preferred embodiment of the framing system of the present invention.

As particularly shown in FIG. 11, the framing system 20 of the present invention is also uniquely adapted for alternative display of a framed object 32. Specifically, a light fixture 46 may be provided in one or both side frame elements 48, which for this purpose preferably would comprise translucent extrusions 49. In this manner the framing system 20 may also comprise a source of illumination of the interior frame space 25. In this embodiment, it is also preferred that the base frame element 50 comprise an opaque extrusion 51 to conceal interior wiring 52 leading to a conventional power cord 54 and conventional electrical plug 55 through a grommet 53 in the base frame element 50.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. For example, those of ordinary skill in the art will recognize that the light fixture 46 depicted in FIG. 11 could be held in place within the translucent extrusions 49 with frictional mounts 57. Additionally, those of ordinary skill in the art will recognize that the upper frame element 56, may also be provided with such a light fixture 46. Those of ordinary skill in the art will also recognize that the light fixture 46 may also be contained within an opaque frame element 21, in which case apertures through the frame element 21 may be provided to direct light into the edges 31 of a glass object 32 supported in the framing system 20 thereby illuminating the object. Finally, those of ordinary skill in the art will recognize that one or more of eht securing members 22 In any case, because the scope of the present invention is much broader than any particular embodiment, the foregoing detailed description should not be construed as a limitation of the scope of the present invention, which is limited only by the claims appended hereto.

What is claimed is:

1. A framing system for dependently supporting an object, said frame comprising:

a plurality of frame elements for perimetrically engaging an object to be framed, said frame elements forming an outer frame perimeter and an inner frame perimeter;

wherein each said frame element is defined one from another by an interiorly projecting slot in said outer frame perimeter; and a plurality of securing members each comprising an extended slot, each said securing member being adapted to engage said frame elements such that each said extended slot projects into said inner frame perimeter upon mating of said extended slots with one each of said interiorly projecting slots.

2. The framing system as recited in claim 1, wherein said frame elements comprise a single structure.

3. The framing system as recited in claim 1, wherein said frame elements comprise a plurality of structures.

4. The framing system as recited in claim 3, said framing system further comprising:

a unitary base; and a unitary top, said unitary top being selectively engageable with said unitary base.

5. The framing system as recited in claim 4, wherein said unitary top comprises a plurality of tongues, each said tongue being adapted to mate with one of a plurality of receiving slots formed in said unitary base.

6. The framing system as recited in claim 5, wherein each said frame element comprises a cylindrical extrusion and wherein each said receiving slot comprises an interior portion of said cylindrical extrusions.

7. The framing system as recited in claim 1, wherein at least one of said frame elements comprises a geometrical extrusion.

8. The framing system as recited in claim 7, wherein each said frame element comprises a geometrical extrusion.

9. The framing system as recited in claim 8, wherein said geometrical extrusion comprises a cylindrical element.

10. The framing system as recited in claim 7, wherein said geometrical extrusion comprises a toroidal element.

11. The framing system as recited in claim 10, said framing system consisting of three securing members.

12. The framing system as recited in claim 7, wherein:

said geometrical extrusion comprises a substantially translucent material; and said framing system further comprises a light fixture internal said geometrical extrusion, said light fixture being adapted to illuminate a space internal said inner frame perimeter.

13. A method for dependently framing an object, said method comprising the steps of:

placing the object into an inner frame perimeter formed by a plurality of frame elements, each said frame element being defined one from another by an interiorly projecting slot in an outer perimeter formed by said frame elements;

engaging said frame elements with a plurality of securing members, each said securing member comprising an extended slot for mating with a corresponding one of said interiorly projecting slots such that each said securing member projects into said inner frame perimeter to dependently secure the object.

* * * * *